United States Patent [19]

Pfeiler et al.

[11] 4,097,741

[45] Jun. 27, 1978

[54] X-RAY DIAGNOSTICS SYSTEM FOR X-RAY PHOTOGRAPHS

[75] Inventors: Manfred Pfeiler; Kurt Dietz, both of Erlangen, Germany

[73] Assignee: Siemens Aktiengesellschaft, Berlin & Munich, Germany

[21] Appl. No.: 734,102

[22] Filed: Oct. 20, 1976

[30] Foreign Application Priority Data

Oct. 20, 1975 Germany ..... 2546948

[51] Int. Cl.[2] ..... H05G 1/02; H05G 1/44

[52] U.S. Cl. ..... 250/322; 250/408; 250/409

[58] Field of Search ..... 250/408, 409, 322

[56] References Cited

U.S. PATENT DOCUMENTS

| | | | |
|---|---|---|---|
| 3,916,192 | 10/1975 | Schmitmann et al. | 250/322 |
| 3,952,199 | 4/1976 | Franke | 250/408 X |
| 3,969,625 | 7/1976 | Finkenzeller et al. | 250/322 |
| 3,974,385 | 8/1976 | Grim | 250/409 X |

*Primary Examiner*—Archie R. Borchelt

*Attorney, Agent, or Firm*—Hill, Gross, Simpson, Van Santen, Steadman, Chiara & Simpson

[57] ABSTRACT

The organ-related keys for selecting radiographic exposure parameters according to a predetermined programming may include special correction keys to be actuated according to an estimate of patient transparency, or in any event the keys representing respective organs imply a range of expected attenuations of the incident radiation due to the presence of the patient. The disclosed system senses the implied patient transparency range from the setting of the control keys, and compares the same with an actual value signal due to the specific patient and takes suitable control action in the event that patient bulk does not fall within the predetermined range. For example, the control action may comprise a shut off of the radiation source, or a change of X-ray tube high voltage setting or of anode current. It is also possible for the system to automatically store data on the parameters selected such as the geometry of the camera and/or the X-ray film in service, and to utilize such data to improve the accuracy of the transparency actual value signal, or to aid in determining the response to be made by the system to detected discrepancies.

6 Claims, 6 Drawing Figures

X-RAY DIAGNOSTICS SYSTEM FOR X-RAY PHOTOGRAPHS

BACKGROUND OF THE INVENTION

The invention concerns an X-ray diagnostics system for X-ray photographs with a console with means for adjustment of the radiographic values which means is programmed according to the particular bodily organ under examination, the system further including adjustment means for adapting at least one of the programmed radiographic values to the X-ray transparency of the patient, and an X-ray automatic exposure timer with a radiation detector which, viewed in the direction of the radiation, is arranged behind the patient, the automatic exposure timer controlling a switch-off stage for switching off the X-ray radiation when it has reached a predetermined radiation dose.

An X-ray diagnostic system of this type has been described in the brochure "OPTIMATIC-System for decentralized programmed radiography," of Siemens AG, Order No. MR 50/1207, for example. In this X-ray diagnostics system, one control console with organ keys for adjusting the photographic values, is assigned to each examination unit. Since the constitution of the patients varies greatly, it is necessary to undertake an adaptation of the programmed photographic values to the X-ray transparency of the patient. In the prior X-ray diagnostic system, three keys are provided on one control console for this purpose. These three keys are assigned respectively to a thin, an average and an obese patient. Thus, corresponding to the respective patient, besides the organ-related key, one of these three correction keys must be additionally depressed in order to adapt the photographic value to the X-ray transparency of the patient. The pre-programmed X-ray tube high voltage is thereby changed, in the case of a thin patient, it is reduced, and in the case of an obese patient it is increased.

In practice, it is possible for the user of the X-ray diagnostic system to actuate the wrong correction key, for example in the case of an obese patient, to depress the correction key on the console intended for a thin patient. The obese patient is thus photographed with too low an X-ray tube high voltage, so that the automatically controlled photographing time is comparatively long giving a maximum load on the tube. Conversely, it is conceivable in the case of a thin patient for the correction key assigned to an obese patient to be actuated, so that the thin patient is photographed with too high an X-ray tube high voltage. In the first instance with too low an X-ray tube high voltage, the photograph will, indeed, be distinguished by extremely good contrast values which are better than required; however, there will also be a comparatively high load on the X-ray tube which may lead to premature failure. In addition, there is also a radiation load on the patient which is higher than necessary. In the second instance where the X-ray tube voltage is too high, the contrast values may be unsatisfactorily low. The photograph must be repeated, which leads to an additional radiation load on the patient. In this instance, there is no disadvantage regarding tube life.

Similar conditions, only with a more pronounced, that is an even more disadvantageous, effect results if a wrong organrelated key, or program key is depressed. Selection of high voltage on the X-ray tube is very strongly dependent upon the organ and the examination technique.

SUMMARY OF THE INVENTION

Therefore, it is the object of the invention to construct an X-ray diagnostic system of the type initially cited such that defective photographs or an excessively high load on the X-ray tube, as a consequence of an incorrectly actuated organ-related or correction key, can be avoided.

As specified by the invention, this problem is solved through means for the formation of a transparency actual value signal which corresponds to the X-ray transparency of the patient, suitable means such as a comparator being provided for comparing the transparency actual value signal with a signal corresponding to the photographic values selected on the console. The comparator delivers an output signal when the difference or quotient of both its input signals drops out of a predetermined value range. In the illustrated embodiments, the X-ray transparency of the patient which is represented by the selected organ-related and/or correction keys is compared with the actual X-ray transparency of the patient, and a differential or quotient signal is formed such that it is possible to either switch off the X-ray tube, if necessary, or to automatically change a photographic value, particularly the X-ray tube high voltage. In addition, it is conceivable to indicate the existence of such comparison signal, and to either occassion the user to make a new photograph (if the tube is switched off) or to call his attention to the correction which has been made. In the instance of switching off the X-ray tube, the possibility is also conceivable, through a comparison of the dose expended for the discontinued photographing process with the dose to be expended if the same photographic process is carried to completion, to draw a conclusion, which is to be indicated, regarding the further serviceability of the partially exposed X-ray film, in the event that such X-ray film represents the picture recording means.

Other objects, features and advantages of the invention will be apparent from the following detailed description of several illustrative embodiments, given by way of example and not by way of limitation, and taken in connection with the accompanying drawings.

DETAILED DESCRIPTION

Figure 1:
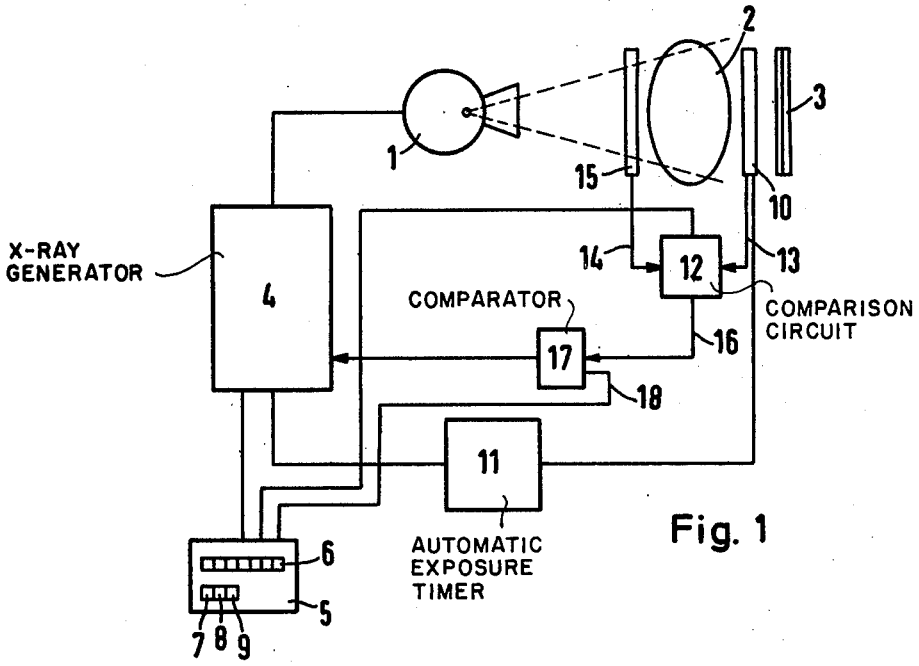
FIG. 1 illustrates a first exemplary embodiment of an X-ray diagnostic system in accordance with the present invention.

FIG. 1 illustrates an X-ray tube 1, which causes radiation to pass through a patient 2, and produces X-ray photographs on an X-ray film which is housed in a cassette 3. X-ray tube 1 is fed by an X-ray generator 4 to which a control console 5 is connected. Control console 5 is assigned to photographic system 1, 3. Control console 5 is provided with a series of organ-related keys 6. A combination of photographic values is assigned to each key of the organ-related key series 6; that is, in order to photograph a specific body organ, one of the keys 6 must be depressed, whereby all photographic values are selected. Three correction keys 7, 8 and 9 are present on the console 5 for the purpose of adaptation to the thickness of the object under examination. Key 7 is to be actuated in the case of a thin patient, key 8 is to be activated in the case of an average patient, and key 9 is to be actuated in the case of an obese patient. The photographic values selected by the actuated key of the organ-related key series 6 are adapted to the constitution of the particular patient according to which of the respective keys 7, 8, 9 is also depressed. The X-ray diagnostic system according to FIG. 1 in addition contains an automatic exposure timer and switch-off component 11 which is connected with the output of radiation detector 10. When a predetermined dose of X-ray radiation has acted on the X-ray film in cassette 3, the automatic exposure timer of component 11 actuates the switch-off stage, and the switch-off stage which is connected to the generator 4 then shuts off the X-ray radiation.

In order to detect the X-ray transparency of the patient, a comparison circuit 12 is provided having two inputs 13 and 14. The radiation detector 10 is connected to input 13, and a second radiation detector 15 is connected to the other input 14, the second detector 15 being located in front of the patient 2 with respect to the direction of the radiation from source 1. Signals are connected to inputs 13 and 14 which correspond to the transmitted radiation dose and to the incident radiation dose, respectively, and it is from these signals that a comparison signal is generated in comparison circuit 12. The comparison signal at output 16 may correspond either to the quotient or to the difference in the respective dose rates as sensed at the detector 15 and at the detector 10. The comparison signal may be modified electronically in accordance with the geometry of the particular photographic system; that is with regard to the distance between the focus of the X-ray tube 1 and the detector 15 and between the detector 15 and the detector 10, so that the comparison signal at output 16 is a function of the transparency of patient 2 during operation of the system at the tube high voltage which results from the respective depressed organ-related key and correction key. The transparency actual value signal on line 16 is fed to one input of a comparator 17 to the other input 18 of which a signal is fed which corresponds to the respective depressed keys 7, 8 or 9; that is to the selected patient transparency. Comparator 17 compares the signals on its input lines 16 and 18 and delivers a switch-off signal to generator 4 if the difference or the quotient of these two input signals does not fall into a predetermined value range; that is if the actual transparency of patient 2 deviates too widely from the transparency selected by means of keys 7, 8 or 9.

Figure 2:
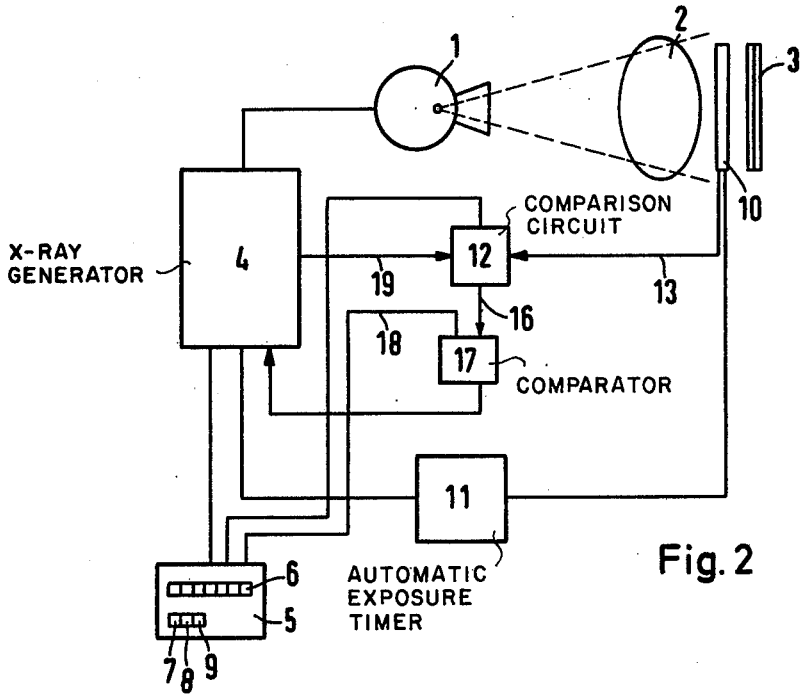
FIG. 2 illustrates a second exemplary embodiment of an X-ray diagnostic system as specified by the invention.

In the exemplary embodiment according to FIG. 2, parts which are identical to parts of the embodiment according to FIG. 1 are provided with the same reference numerals. The difference between the two embodiments consists in that one input 19 of comparison circuit 12 is connected to generator 4 so that the comparison circuit 12 receives a signal on its input which corresponds to the adjusted photographic values; namely, the X-ray tube high voltage and the X-ray tube anode current. This signal is a criterion for the dose rate in front of the patient and can therefore replace the signal supplied by line 14 in the embodiment of FIG. 1.

In the illustrated embodiments, switching off of generator 4 proceeds immediately after initiation of an X-ray photograph if the correction key 7, 8 or 9 which is depressed does not agree with the actual conditions; that is if the X-ray transparency of the patient which is to be expected based on the depressed correction key deviates too greatly from the actual X-ray transparency. Instead of switching off the generator, it is also conceivable within the framework of the invention to undertake an automatic change of the photographic values, particularly of the X-ray tube high voltage and/or of the X-ray tube anode current, with regard to an adaptation to the actual X-ray transparency of the patient. Moreover, the invention is also applicable when no correction keys are present. The signal on line 18 is then dependent on the organ related key which is depressed in each instance, and this signal thus likewise corresponds to the selected transparency of the photographic object.

The geometry of the camera can be taken into cnsideration for a specific device by means of a constant approximate value in the comparison circuit 12 of FIG. 1 and FIG. 2. However, it is also possible to electrically interrogate the actual intervals and, in this manner, modify comparison member 12 with the aim of forming a more accurate transparency actual value signal.

Figure 3:
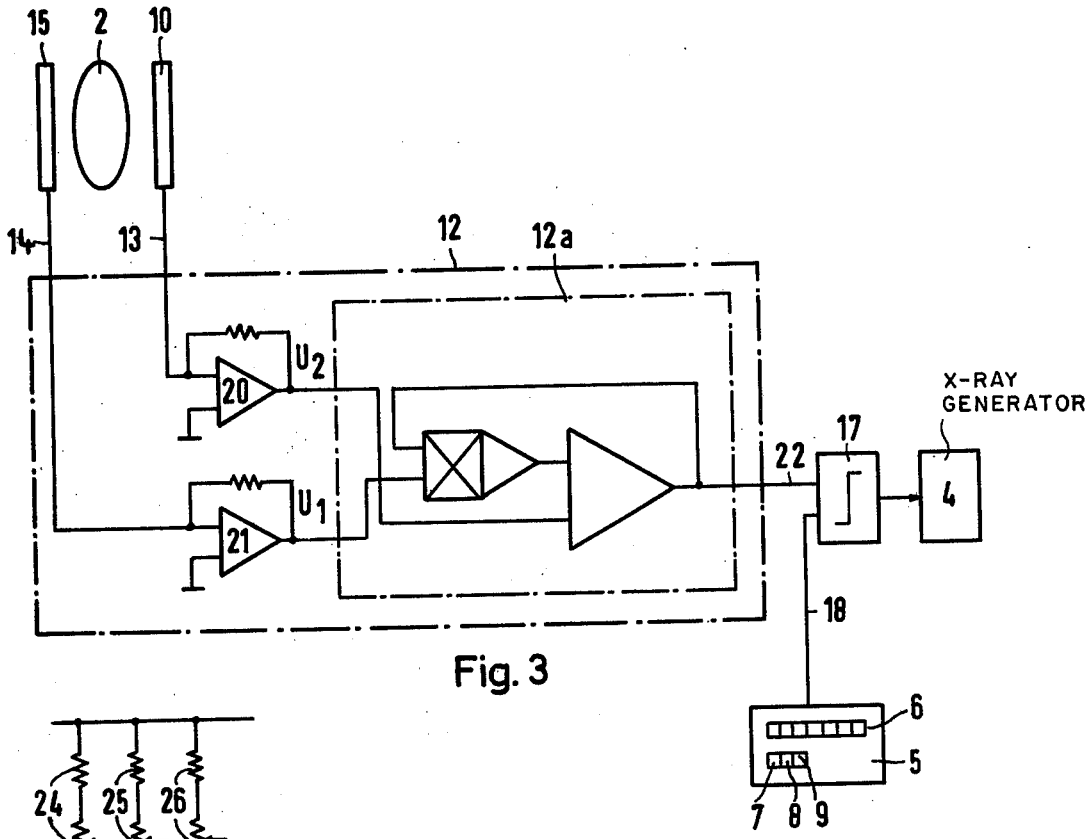
FIGS. 3 and 4 illustrates circuit details for a sample embodiment according to FIG. 1.

FIG. 3 illustrates more specifically a circuit in accordance with the exemplary embodiment of FIG. 1. One current-voltage transformer 20, 21 is connected to each of the detectors 10, 15. Voltages $U_2$ and $U_1$ supplied at the outputs of these current-voltage transformers 20, 21. These voltages $U_2$ and $U_1$ are fed to a dividing component 12*a*. Dividing component 12*a* forms the quotient $U_2$; $/U_1$ that is, an electric signal corresponding to the transparency of the patient 2, at its output 22. This signal is fed to the one input of a threshold value element 17 which acts as a comparator. A signal is connected to the other input 18 which represents the nominal value for the transparency of the patient 2 which is to be expected in view of the organ-related key which has been actuated. The output signal of comparison component 17 is fed to X-ray generator 4 as shown in FIG. 1.

Figure 4:
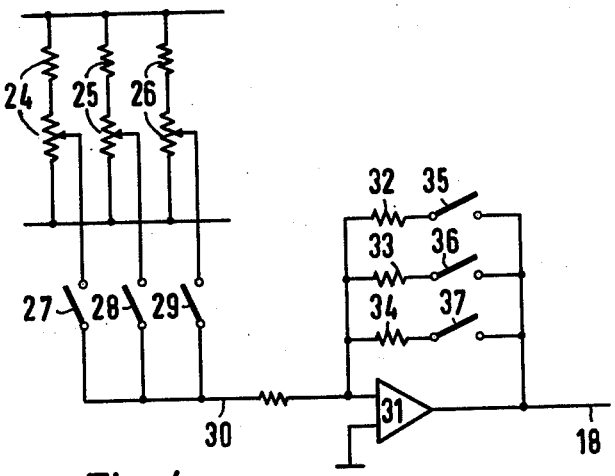

FIG. 4 illustrates how the nominal value signal on the line 18 is formed. For this purpose, a series of voltage dividers are present in the control console 5. Only three of these voltage dividers are illustrated in FIG. 4. One voltage divider each is assigned to each of the organ-related keys 6. Voltages can be tapped on voltage dividers 24 through 26, etc., by means of switches 27, 28, 29, etc., which are actuated by the respective keys 6. However, always only one voltage divider is connected to line 30, corresponding to the organ related key 6 which is actuated. The signal on line 30 is supplied to a feedback amplifier 31 in whose feedback path resistance 32, 33, 34 can be selectively connected by means of respective switches 35, 36 37. Switches 35 through 37 are actuated by keys 7, 8 and 9, respectively. If the first of the organ-related keys 6 and the key 7 are actuated, for example, switches 27 and 35 will be closed and a corresponding signal will be connected on line 18.

In the exemplary embodiment according to FIG. 2, the signal $U_1$ corresponding to signal $U_1$ in FIG. 3 is delivered directly from X-ray generator 4 via line 19, and is developed in accordance with the selected X-ray tube voltage and X-ray tube current; that is it is formed, for example, by the setting means which selects these magnitudes.

As an example of operation for the embodiment of FIGS. 3 and 4, if keys 6 and 9 corresponding to contacts 27 and 37, FIG. 4, are actuated, then an obese patient is to be expected. Most conveniently in this case, component 12*a*, FIG. 3, may be switched by means of reversing contacts controlled by key 9, so that the $U_1$ and $U_2$ inputs to component 12*a* are reversed, and line 22 receives the ratio $U_1/U_2$. For an obese patient, $U_1/U_2$ would be expected to promptly reach a relatively high value corresponding to a relatively low dose rate at detector 10. Thus amplifier 31, FIG. 4, would supply a relatively high set point voltage value at conductor 18. Comparator 17 would then be energized, or alternatively gated into the circuit controlling the X-ray source shortly after the turn-on of the X-ray source by means of the exposure control button. If, by the time comparator 17 was in operating condition, or alternatively by the time the output of comparator 17 was placed in control of a turn-off circuit for the X-ray source as by enabling an AND gate(49, FIG. 5), between comparator 17 and such turn-off circuit of component 4, if the ratio $U_1/U_2$ had not increased to a relatively high value (as it would for an obese patient), the comparator would respond to the higher threshold setting voltage at 18, and supply a turn-off (logical one level) signal which would effect turn off of the X-ray source.

For the case where the key 7 is actuated to close contact 35, the input ratio $U_2/U_1$ would be expected to be relatively high because of the low absorption of a relatively thin patient. Thus again a high set point voltage value would be supplied to conductor 18, and if to the contrary an obese patient was present, the ratio $U_2/U_1$ would remain relatively low, and the X-ray source again would be shut off as soon as comparator 17 was enabled.

For an average patient, as selected by key 8, if both a thin patient and an obese patient were desired to be detected, two circuits such as 12 could be provided, one supplying the ratio $U_2/U_1$ at conductor 22, FIG. 3, to detect an obese patient, and the other being enabled by a key 8 true conductor (36', FIG. 5) and supplying the ratio $U_1/U_2$ at an output (22*c*, FIG. 5), to detect a thin patient. The respective circuits would then both be activated and connected to respective associated comparators (17*b* and 17*c*, FIG. 5), which would be connected to the shut off control via an OR gate or the equivalent. Each comparator could receive a signal from the same amplifier 31 via conductor 18, and the respective circuits 12 would be adjusted for the case of an average patient to supply respective ratios $U_1/U_2$ and $U_2/U_1$ above the common set point level at 18, so that the exposure would proceed normally so long as the actual patient produced attenuation within a certain selected range representing patients of average thickness.

Figure 5:
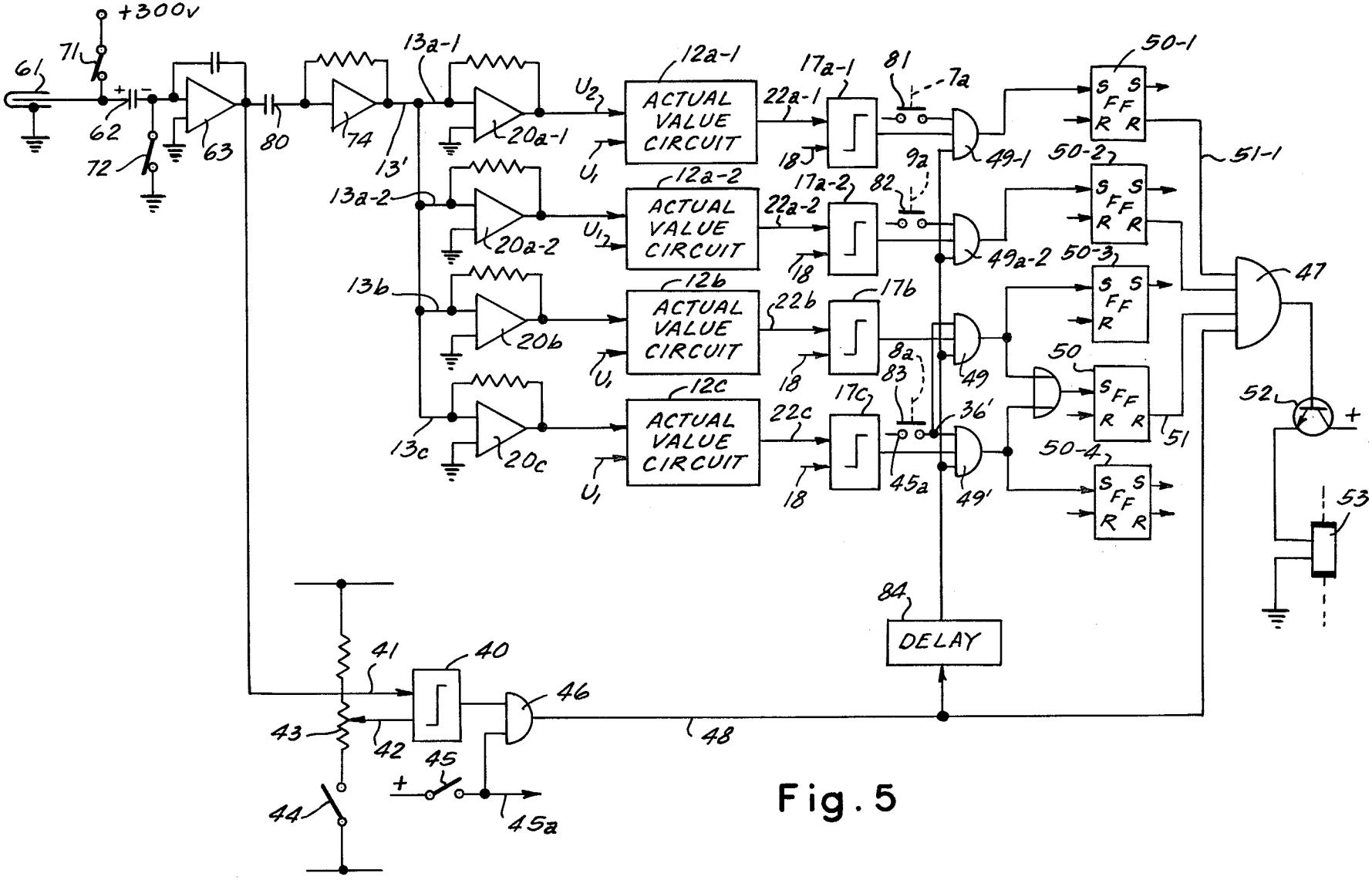
FIG. 5 illustrates exemplary details of an arrangement according to FIG. 1 or FIG. 2 for sensing when patient transparency departs from a predicted average range, and for shutting off the X-ray source if the actual transparency is either above or below a selected average range.

For the sake of a diagrammatic indication, FIG. 5 shows details of an automatic exposure and shut off circuit 11 including a comparator 40 for receiving a signal corresponding to the integrated dose rate at 41 from detector 10 and for receiving a set point signal at 42 from the console selection means of console 5 which may include a voltage divider 43 and switch 44. The switch 44 may be actuated by certain of the controls keys 6 such as the one actuating contact 27. Actuation of the exposure release button (not shown) associated with console 5 may serve to close contact 45 for the duration of the exposure. Closure of contact 45, enables gate 46 which in turn enables gate 47 via conductor 48. A logical one enabling potential on conductor 48, after any desired time delay, may enable a gate 49 and partially enable gate 49' of X-ray generator component 4, thus enabling a shut off circuit including bistable flip-flop circuit 50 and conductor 51. If then the dose rate signals (the differential of the signal at 41 with respect to time), at conductors 13*b* and 13*c* have not reached their proper relative values for an average patient, the higher signal at 18 will produce a logical one output from one of the comparators 17*b* or 17*c* which will be transmitted to gate 49 or 49'. The gates 49 and 49' being enabled (after a suitable time delay) by the logical one signal level from conductor 48, will each be enabled to transmit a logical one signal level to the set input of flip-flop circuit 50, setting the flip-flop, and disabling gate 47 by means of its reset output conductor 51 shifting to a logical zero level. With gate 47 disabled, transistor 52 is turned off, and relay 53 is deenergized, terminating the exposure.

If the actual value signals at 22*b* and 22*c* conform with the anticipated range as represented at 18, the signals at 22*b* and 22*c* will be higher than that at 18 at the time gates 49 and 49' are enabled. Flip-flop 50 may be reset at the same time contact 45 is opened whenever an exposure is terminated, and flip-flop 50 will remain reset under the normal operation when gates 49 and 49' are enabled, so that the reset output 51 thereof will retain a logical one level and enable control of the exposure by the timer 40 of circuit 11. When the total dosage reaches the value set by the setting means 42, 43, 44, the potential at conductor 41 will rise above the set value at conductor 42, and comparator 40 will switch from a logical one output level to a logical zero output level actuating switching means 46, 47 to terminate the exposure in the normal way.

DETAILED DESCRIPTION OF FIG. 5

For the sake of a more detailed illustration of the embodiment of FIG. 1 or FIG. 2, FIG. 5 shows a detailed arrangement for responding to the patient transparency keys 7, 8 and 9, and for switching off the X-ray source in case the actual patient transparency is outside of the predicted range. In FIG. 5, by way of example, detector 10 is shown as comprising a radiation measurement chamber 61 which is connected to a coupling capacitor 62. During an X-ray exposure, this capacitor 62 serves as an externally non-influenced voltage source for radiation measurement chamber 61. An operational amplifier 63, which is connected as an integrator, is connected to the output side of coupling capacitor 62. The output signal of said operational amplifier 63 is fed to input 41 of differential amplifier 40. The constant voltage supplied by the voltage divider 43 is connected to the other input 42 of the differential amplifier 40. The output of the differential amplifier 40 controls a switch-off device for the X-ray tube via the AND gate 46 which becomes enabled upon closure of contact 45. The contact 44 is representative of contacts which may be controlled in accordance with the particular key 6 of console 5 which has been actuated. Once the desired key 6 has been actuated, the exposure release button may be operated which results in the closure of contact 45 for the duration of an exposure. Closure of contact 45 supplies operating potential via line 45*a* to various points in the circuit. Actuation of the exposure release button serves to open contacts 71 and 72 for the duration of an exposure so as to remove the plus 300 volt supply from the positive terminal of capacitor 62, and so as to remove ground potential from the negative terminal of capacitor 62. Capacitor 62 is then free of its charging circuit and transmits the current flow of radiation detector 1, which may be an ionization chamber in the present example, to integration amplifier 63. The integration of the current flow to the input of amplifier 63 with respect to time brings about a voltage rise at the amplifier output which is in the nature of a ramp function and is a measure of the radiation dose which has impinged on the ionization chamber 61 since the opening of contacts 71 and 72. When the output voltage of amplifier 63 has reached a value equal to the voltage value selected for application to input 42 of the differential amplifier 40, the differential amplifier 40 produces an output signal which brings about a switching off of the X-ray tube and the completion of the exposure. The voltage at input 42 may be selected in accordance with the particular key 6 which is actuated such that the radiation dose called for will result in an optimum film density.

The output voltage of operational amplifier 63 is also fed to an additional amplifier 74 via a capacitor 80 such that the components 74 and 80 form a differentiating circuit, and supply an output signal which is a function of the dosage rate at the ionization chamber 61. The response of the component 74, 80 is such that a relatively steady voltage level will appear at conductor 13' within a short time after an exposure is initiated. Thus, an output signal from one of the actual value circuits such as 12*c* will promptly assume a relatively low value below the predicted level at conductor 18, unless the correct one of the keys 7, 8 and 9 has been actuated.

FIG. 5 illustrates an actual value circuit 12*a*-1 which may correspond identically to the circuit 12*a* of FIG. 3. Instead of showing a reversing switch at the input to circuit 12*a*-1, a second actual value circuit 12*a*-2 is shown which is also identical to the circuit 12*a* of FIG. 3 except that the inputs U1 and U2 are reversed for circuit 12*a*-2 in comparison to 12*a*-1. Thus circuit 12*a*-1 provides a signal in proportion to a ratio U2/U1, while circuit 12*a*-2 supplies an output at line 22*a*-2 which is a function of U1/U2. The circuits 12*a*-1 and 12*a*-2 are shown as having individual input amplifiers such as 20*a*-1 and 20*a*-2 so that the actual signal amplitude levels supplied to the respective circuits may differ from each other and be such as to provide sensitive response to the respective different ratios. In particular, the amplification of amplifier 20*a*-1 and of the corresponding input amplifier for supplying signal U1 to actual value circuit 12*a*-1 may be such that the output signal U2/U1 provides a substantial amplitude change for the case where instead of a moderately thin patient as predicted by the actuation of key 7, the patient actually present would be more properly characterized by key 8, for example. Similarly for the case of actual value circuit 12*a*-2, the input signals U1 and U2 are adjusted to signal levels such that the ratio U1/U2 will exhibit a substantial change where, for example, instead of a patient of moderate obesity and such as would fall within the scope of the actuated key 9, the patient actually present would be better characterized by selection of key 8.

If desired, circuitry may also be provided for detecting the situation where the key 8, for example, has been incorrectly selected. To illustrate this case, actual value circuits 12*b* and 12*c* have been indicated in FIG. 5 each of which may conform identically to circuit 12*a* of FIG. 3. Individual amplifiers 20*b* and 20*c* have been indicated as supplying the signals U2 so as to indicate that the levels of the input signals to circuits 12*b* and 12*c* may also be selected independently of each other and independently of the inputs to actual value circuits 12*a*-1 and 12*a*-2.

For the sake of further illustrative detail, respective corresponding comparator circuits 17*a*-1, 17*a*-2, 17*b* and 17*c* have been indicated as associated with the output 22*a*-1, 22*a*-2, 22*b* and 22*c* of the actual value circuits. For the sake of the present example, the second input to each comparator circuit has been designated by the reference numeral 18 to indicate that a common conductor can supply a predicted patient transparency signal level to each of the comparator circuits, as a specific example.

For the sake of further illustration of detail, gate circuitry has been indicated at 49 which provides for the selective activation of a shut-off circuit corresponding to the particular one of the keys 7, 8 or 9 which has been selected. Thus, if key 7 is actuated, a suitable circuit is latched which may include a relay having mechanical coupling with contacts such as indicated at 81 such that gate 49-1 is enabled as soon as contact 45 is closed to supply a logical one signal level at conductor 45*a*. If the signal U2/U1 is below the level of the signal at conductor 18 at this time, for example, then comparator 17*a*-1 may supply a logical one output signal to a second input of gate 49-1, causing bistable circuit 50-1 to shift out of its initial reset condition with a logical one signal level at its output 51-1. The other bistable circuits 50 and 50-2 will necessarily remain in reset condition at this time since the associated shut-off circuits are not enabled with key 7 actuated.

With key 9 actuated, the associated latching circuit may have a mechanical coupling 9*a* with contact 82 closing this contact and preparing the associated circuit for controlling relay 53.

For the case where key 8 is actuated, the associated latching circuit may be mechanically coupled as indicated at 8*a* with a contact 83 whose closure connects conductor 45*a* with the enabling line 36'. For the case where a single comparator element such as indicated at 17 in FIG. 3 is not used in each case, but a separate comparator 17*b* is utilized with the actual value circuit 12*b* as shown in FIG. 5, it is also necessary that gate 49 be selectively activated depending on which of the keys 7, 8 or 9 is actuated, and accordingly conductor 36' is shown as controlling the partial enablement of gate 49 as well as gate 49'. In the embodiment shown in FIG. 5, a suitable delay element is indicated at 84, such that each of the gates 49, 49', 49-1 and 49-2 can only be enabled at a suitable time interval after a logical one signal level appears on conductor 48. The time interval is such as to ensure that the various transmitted values U1 and U2 are at stable levels, properly representing respectively the incident radiation and the transmitted radiation.

In FIG. 5, the conductors designated U1 may, of course, represent outputs of respective individual amplifiers corresponding to amplifier 21 in FIG. 3, the individual amplifiers having individually set amplification levles, and all such amplifiers having their inputs connected in common either to the conductor 14 of FIG. 3 or to the conductor 19 of FIG. 2.

In summary in operation of the particular embodiment of FIG. 5, actuation of key 7 will close contact 81 via mechanical coupling 7*a*, actuation of key 8 will close contact 83 via mechanical coupling 8*a* and actuation of key 9 will close contact 82 via mechanical coupling 9*a*. With one of the keys 7, 8 or 9 actuated, the respective amplifiers 20*a*-1, 20*a*-2, 20*b* and 20*c* may be set to amplification levels so as to detect deviations from the predicted patient transparency. Thus, if a thin patient is predicted by closure of contact 81, bistable circuit 50-1 will be set if the patient actually present exhibits average transparency or transparency corresponding to a relatively heavy patient. Where a patient of average transparency is predicted by closure of contact 83, if the actual patient transparency as sensed by the system corresponds either to a thin patient or to a relatively heavy patient thickness, then bistable circuit 50 will be set to immediately terminate the exposure, as an example. If a relatively heavy patient is predicted by closure of contact 82, then the presence of a patient exhibiting a medium thickness or a relatively great transparency will result in the setting of bistable circuit 50-2, again terminating the exposure, for example.

DETAILED DESCRIPTION OF FIG. 6

Figure 6:
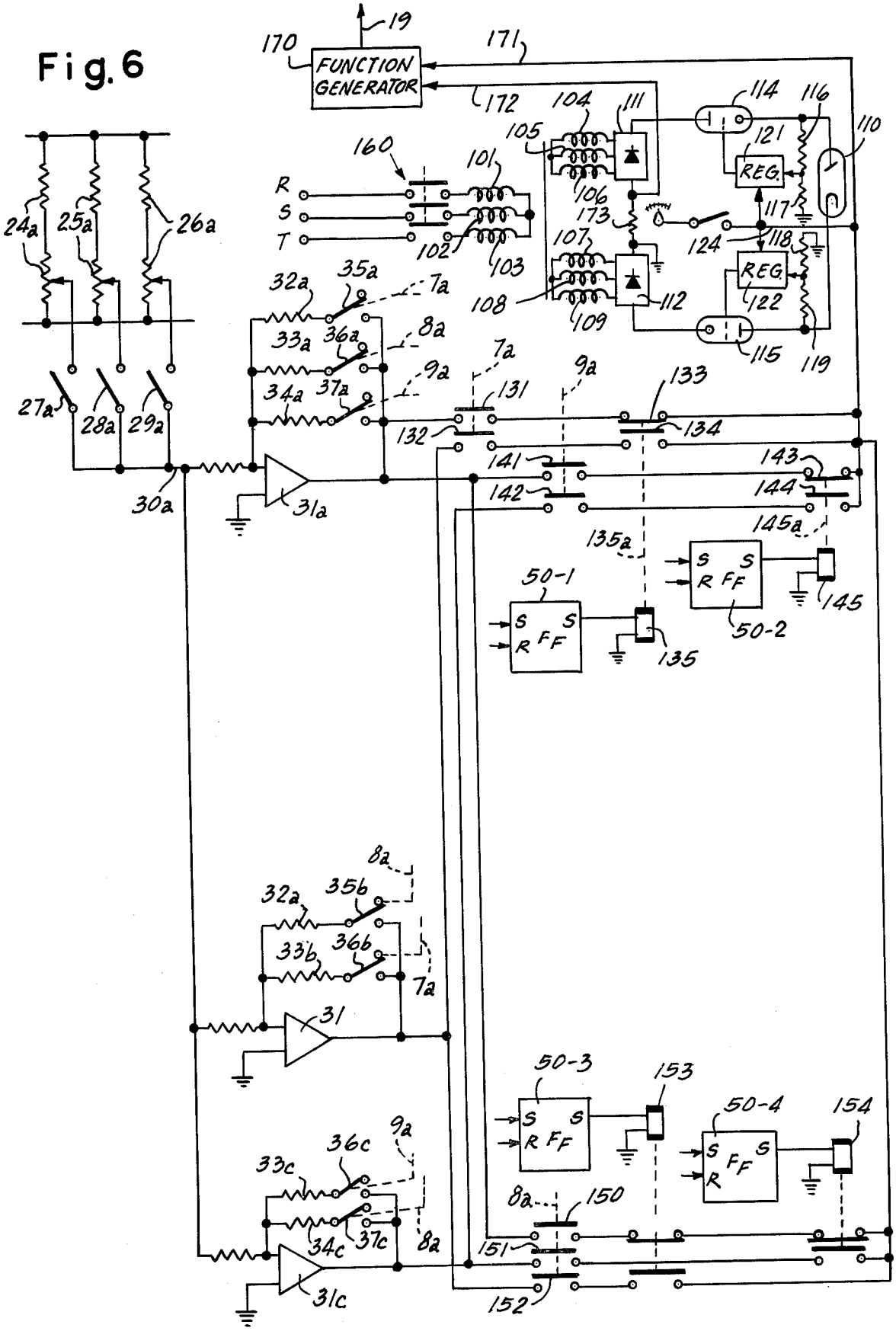
FIG. 6 illustrates exemplary details of a modification of the embodiment of FIG. 1 or FIG. 2 whereby the X-ray tube voltage is automatically changed if the patient is found to exhibit an actual transparency value which lies outside a predicted range.

FIG. 6 illustrates exemplary details of an embodiment according to FIG. 1 or FIG. 2 wherein the X-ray tube high voltage is automatically changed if the patient is found to exhibit an actual transparency value which lies outside a predicted range.

For the sake of a diagrammatic indication, an X-ray generator is indicated in FIG. 6 corresponding to that identified as "PANDOROS OPTIMATIC" at page 24 of the aforementioned brochure. Another brochure giving a description of this generator is identified as Siemens AG Order No. MR 65/7030, for example. By way of example primary windings 101–103 may energize respective sets of secondary windings 104–106 and 107–109 so as to supply power to an X-ray tube 110 via respective polyphase rectifier networks 111 and 112. High-power control triodes 114 and 115 control the high voltage supply to the tube 110. For this purpose, respective voltage dividers 116, 117 and 118, 119 supply respective actual voltage values to respective regulators 121 and 122 which are shown as receiving a common set point voltage via conductor 124. Thus, the actual X-ray tube voltage is measured by means of the voltage dividers, and the actual voltage is maintained at the desired set point level by means of electronic regulators 121 and 122 which are connected with the control grids of the respective triodes 114 and 115.

For the sake of the present illustrative example, it is assumed that the set point voltage for tube 110 is selected in accordance with the particular key 6 of FIG. 1 which has been actuated. Thus, for example, if the first of the series of keys 6 is actuated, this may result in the closure of contact 27*a* of FIG. 6 so as to supply a particular selected reference voltage from the voltage divider 24*a*. Other of the keys 6 may result in the closure of contact 28*a* or contact 29*a* so as to supply the reference voltage of voltage divider 25*a* or 26*a*, for example.

In the illustrated embodiment, it is also assumed that the keys 7, 8 and 9 are coupled with respective contacts 35*a*, 36*a* and 37*a* which are in series with respective resistors 32*a*, 33*a* and 34*a* in respective feedback paths of operational amplifier 31*a*. Thus, as indicated by the mechanical couplings 7*a*, 8*a* and 9*a*, if key 7 is actuated, contact 35*a* is closed, if key 8 is actuated, contact 36*a* is closed, and if key 9 is actuated, contact 37*a* is closed. The result is that for a particular selection of a key 6 and of one of the keys 7, 8 or 9, a set point voltage will be supplied to conductor 124 of the high voltage generator so as to establish a desired corresponding level of the X-ray tube high voltage.

The embodiment of FIG. 5 has indicated the manner in which respective flip-flops 50-1 and 50-2 may be actuated to a set condition if the actuation of key 7 or 9 proves to be an inaccurate prediction as to patient transparency. These respective flip-flop circuits have been shown also in FIG. 6 so as to illustrate that the setting of the respective flip-flops may produce a desired changeover in the high voltage setting for the high voltage generator of FIG. 6. Thus, if key 7 is actuated, contacts 131 and 132 may be closed which serve to partially enable a further operational amplifier circuit including amplifier 31*b*, feedback resistors 32*b*, 33*b* and contacts 35*b*, 36*b*. Normally closed circuit 133 connects amplifier 31*a* with conductor 124, while normally closed contact 134 of relay 135 will serve to complete the enablement of circuit 31*b* in the event that actuation of key 7 did not provide an accurate prediction as to patient transparency. Specifically, energization of relay 135 will open contact 133 and close contact 134. As indicated by the mechanical coupling line 7*a*, for the illustrated embodiment, it may be assumed that operation of key 7 will also close contact 36*b*, so that upon actuation of relay 135, amplifier 31*b* in conjunction with feedback resistance 33*b* will provide the corrected set point at conductor 124 for the X-ray generator.

Similarly, if key 9 is operated, contacts 141 and 142 are closed so as to put relay 145 in control of the generator output voltage set point. The relay 145 controls contacts 143 and 144 so that when the patient transparency has been correclly predicted, X-ray high voltage is controlled from amplifier 31*a*, while if patient thickness is less than predicted, contact 133 will open and contact 134 will close to place the high voltage under control of amplifier 31*c*, actuation of key 9 having closed contact 36*c* as indicated by dash line 9*a*.

For the case of actuation of key 8, FIG. 5 shows flip-flops 50-3 and 50-4 which are also enabled by means of contact 83, the flip-flop 50-3 being set in response to a logical one output from comparator 17*b*, and flip-flop 50-4 being set by a logical one output from comparator 17*c*. Thus flip-flop 50-3 is set when key 8 has been actuated, but the patient is above the selected medium range, while flip-flop 50-4 is set if key 8 has been selected and the patient proves to have a thickness below the medium range. Accordingly, referring to FIG. 6, actuation of key 8 closes contacts 150–152, placing relays 153 and 154 in control of the set point supplied to conductor 124. As indicated by dash lines 8*a*, operation of key 8 may be considered to close contact 35*b* and 37*c*, and operation of relay 153 will accordingly supply the output of operational amplifier 31*b* with feedback resistance 32*b* to conductor 124, while operation of relay 154 will supply the output of amplifier 31*c* in conjunction with feedback resistance 34*c* to the set point conductor 124 for controlling X-ray voltage.

Summarizing operation, it may be assumed for the present illustrative example that actuation of the exposure release button will close contacts 160 in the primary circuit of the high voltage generator, this circuit, for example, being under the control of the conventional automatic exposure timer of the type indicated in FIG. 5. If key 7 has been actuated, amplifier 31*a* in conjunction with resistance 32*a* will supply the set point potential to conductor 124. If, however, the patient thickness is greater than the predicted range, flip-flop 50-1, FIGS. 5 and 6, will be set, energizing relay 135 and connecting set point conductor 124 with amplifier 31*b* and feedback resistance 33*b*. Since the patient is not so thin as predicted, the result may be an increase of high voltage to a value suitable for a patient in the medium range, for example.

If key 9 has been actuated, amplifier 31*a* in conjunction with resistance 34*a* will supply the set point potential to conductor 124, while if the patient is not so heavy as predicted, flip-flop 50-2, FIGS. 5 and 6, will energize relay 145 shifting control to amplifier 31*c* and resistance 33*c*.

If key 8 has been operated, amplifier 31*a* will supply the set point potential in conjunction with resistance 33*a*. If, however, the patient proves to be heavier than the established average range, flip-flop 50-3, FIGS. 5 and 6, will be set, energizing relay 153, and placing the generator high voltage circuit under the control of amplifier 31*b* in conjunction with resistance 32*b*. If the patient is more transparent than the predicted range, flip-flop 50-4 will be set, energizing relay 154, and transferring control to amplifier 31*c* in conjunction with resistance 34*c*.

With the exemplary detailed circuitry of FIGS. 5 and 6 has illustrated the use of mechanical switching, it will be understood that, solid state switching may be utilized. As is apparent from U.S. Pat. No. 3,932,759, instead of a mechanical linkage between the operation of switches such as 6–9 and various contacts, it is equally possible to utilize the operation of the respective switches to select respective series of bistable memory cells, the contents of the selected series of cells being transferred to a read out register, which read out register may then control energization of desired relays or other switching means so as to establish the desired settings such as indicated in the present embodiment.

For an arrangement according to FIG. 6 where the X-ray tube high voltage is to be changed from the setting value normally introduced by means of amplifier 31*a*, it would be preferable for the embodiment of FIG. 2 to supply a measure of the incident radiation to conductor 19 based on the actual X-ray tube high voltage, and this has been indicated in FIG. 6 by means of a function generator 170 having an input line 171 which by way of example connects with the set point conductor 124. Similarly, a conductor 172 is shown as being connected with a resistance 173 in the anode circuit of the X-ray tube 110, so that the function generator 170 receives measures of the actual X-ray tube voltage and the actual X-ray tube current. A multiplier circuit of function generator 170, for example, would supply an output at 19 which would be responsive to the actual value of incident radiation. Then, if the X-ray tube voltage or current is changed during an exposure operation, the actual value circuitry such as 12*a*-1, 12*a*-2, 12*b* and 12*c* will continue to supply outputs which are a proper measure of the actual patient transparency.

While presently preferred practice of the invention has been described in detail, it will be apparent that any modifications and variations may be effected without departing from the scope of the novel concepts of the present invention.

We claim as our invention:

1. In an X-ray diagnostics system for making X-ray photographs including a control console having console selection means for selecting photographic values according to the organ to be examined, a radiation detector arranged to sense radiation exposure, and X-ray exposure control means connected with said radiation detector and operable for switching off the X-ray radiation when a predetermined radiation dose has impinged on said radiation detector, actual value signal means connected with said radiation detector and operable for forming a transparency-actual value signal which corresponds to the X-ray transparency of a patient being examined, and comparator means connected with said actual value signal means and operable for comparing the transparency-actual value signal with a further signal which corresponds to the photographic values selected at the control console and for supplying an output signal when the transparency-actual value signal deviates from a predetermined value range relative to said further signal.

2. An X-ray diagnostics system according to claim 1 with a second radiation detector disposed for sensing the incident radiation, said actual value signal means comprising comparison means having respective inputs connected with the first-mentioned radiation detector and with the second radiation detector and operable for supplying said transparency-actual value signal as a function of the X-ray transparency of the patient.

3. An X-ray diagnostics system according to claim 1 with said exposure control means comprising switching means for switching off said radiation, and said comparator means having an output connected to said switching means for switching off the radiation when the transparency-actual value signal deviates from the photographic values selected at the control console.

4. An X-ray diagnostics system according to claim 3 with a second radiation detector for sensing the incident radiation and the first-mentioned radiation detector being arranged to sense the transmitted radiation, the actual value signal means being operable to supply an actual value signal as a function of the ratio of the outputs from the first-mentioned and second detectors, and said comparator means being responsive to an actual value signal which is outside of said predetermined value range relative to said further signal to actuate said switching means to switch off said radiation.

5. An X-ray diagnostics system according to claim 1 with said exposure control means including setting means for setting at least one operating parameter for an exposure and being responsive to a predetermined selection at said console selection means to normally set such operating parameter at a first value, but being responsive to said output signal from said comparator means to shift said operating parameter to a second value.

6. An X-ray diagnostics system according to claim 1 with said console selection means being connected with a second input of said actual value signal means and said actual value signal means comprising a comparison circuit for comparing the output of the radiation detector with a signal from the console selection means corresponding to the selected photographic values.

* * * * *